US012227346B2

(12) United States Patent
Hirz

(10) Patent No.: US 12,227,346 B2
(45) Date of Patent: Feb. 18, 2025

(54) LID FOR CLOSING A CONTAINER AND SYSTEM COMPRISING A CONTAINER AND A LID

(71) Applicant: SSI SCHÄFER PLASTICS GMBH, Neunkirchen (DE)

(72) Inventor: Diethelm Hirz, Neunkirchen (DE)

(73) Assignee: SSI SCHÄFER PLASTICS GMBH, Neunkirchen (DE)

( * ) Notice: Subject to any disclaimer, the term of this patent is extended or adjusted under 35 U.S.C. 154(b) by 0 days.

(21) Appl. No.: 18/016,940

(22) PCT Filed: Jul. 12, 2021

(86) PCT No.: PCT/EP2021/069290
§ 371 (c)(1),
(2) Date: Jan. 19, 2023

(87) PCT Pub. No.: WO2022/017847
PCT Pub. Date: Jan. 27, 2022

(65) Prior Publication Data

US 2023/0312198 A1 Oct. 5, 2023

(30) Foreign Application Priority Data

Jul. 21, 2020 (DE) ..... 10 2020 119 257.6

(51) Int. Cl.

| | |
|---|---|
| ***H01L 21/673*** | (2006.01) |
| ***B65D 43/02*** | (2006.01) |
| ***B65D 55/02*** | (2006.01) |
| *B65D 1/22* | (2006.01) |

(52) U.S. Cl.
CPC ..... *B65D 55/02* (2013.01); *B65D 43/0202* (2013.01); *B65D 1/22* (2013.01); *B65D 2543/00194* (2013.01); *B65D 2543/00398* (2013.01); *B65D 2543/00574* (2013.01)

(58) Field of Classification Search
CPC .... B65D 55/02; B65D 55/12; B65D 43/0202; B65D 43/021; B65D 43/02; B65D 1/22; B65D 1/246; B65D 2543/00194; B65D 2543/00398; B65D 2543/00574; B65D 2519/00711; B65D 45/16; B65D 21/0219
USPC ..... 220/784, 324, 780, 315, 281
See application file for complete search history.

(56) References Cited

U.S. PATENT DOCUMENTS

| | | | | |
|---|---|---|---|---|
| 5,957,292 | A | 9/1999 | Mikkelsen et al. | |
| 7,909,166 | B2 * | 3/2011 | Lin | H01L 21/67373 220/323 |
| 8,276,758 | B2 * | 10/2012 | Lin | H01L 21/67373 220/323 |
| 2013/0256256 | A1 | 10/2013 | Krippendorf et al. | |
| 2014/0319020 | A1 | 10/2014 | Gregerson et al. | |

FOREIGN PATENT DOCUMENTS

| | | | |
|---|---|---|---|
| DE | 19718348 | A1 | 11/1998 |
| DE | 20314261 | U1 | 11/2003 |
| DE | 202004015212 | U1 | 2/2005 |

(Continued)

*Primary Examiner* — King M Chu
(74) *Attorney, Agent, or Firm* — Smartpat PLC

(57) ABSTRACT

The invention relates to a lid for closing a container, wherein connectors are arranged on the lid, which are movably mounted in relation to the lateral edge and are guided through a guide, and to a system comprising a lid and a container.

19 Claims, 3 Drawing Sheets

(56) References Cited

FOREIGN PATENT DOCUMENTS

| | | | |
|---|---|---|---|
| DE | 202015103523 | U1 | 8/2015 |
| DE | 102015121865 | A1 | 6/2017 |
| WO | 9906305 | A1 | 2/1999 |

* cited by examiner

LID FOR CLOSING A CONTAINER AND SYSTEM COMPRISING A CONTAINER AND A LID

TECHNICAL FIELD

The disclosure relates to a lid for closing a container and to a system comprising a lid and a container.

BACKGROUND

Small parts or assemblies are ideally transported in reusable containers for transport to their assembly location in series production. To protect such components or assemblies, as the case may be, the containers are normally closed with a lid. Thereby, the lid has the task of protecting the small parts or assemblies contained in the container from external influences. Small parts or assemblies may also constitute dangerous goods. In such a case, the lid or the combination, as the case may be, of lid and container must shield the environment from the hazardous material. This applies in particular to handling errors, such as a fall or overheating, of the closed container. The UN standards and/or the GGVS-ADR-RiD define the necessary minimum requirements for this. Different lids and container lid combinations that meet these requirements are known from practice.

For example, a lid is inserted into receptacles of a container from above. A circumferential support edge on the lateral walls of the container positions the lid such that it does not protrude beyond the top edge of the side surfaces of the container. Four connectors for closing the container are fastened on the surface rotatably around an axis perpendicular to the surface of the lid. The single connector has a hook on its locking side. When the connector is turned to the locking position, the hook engages in a slotted hole of the side part of the container. Two such connectors are arranged on opposite sides of the lid in each case, and the container has the corresponding slotted holes on these side parts. With the lid inserted and four connectors hooked in each case, a lid can not detach from the container.

Another way to close a container with a lid can be achieved by using one or more tension straps. For this purpose, one hook and one tension clamp per tension strap are fastened to a container on opposite side parts of the container. For closing, the lid is inserted on an edge of the container that runs around the inside and does not protrude upwards beyond the lateral edges of the container after insertion. The tension strap is hooked into the hook and then guided over the lid into the tension clamp. A pull on the tension strap presses the lid against the circumferential edge. Usually, at least two tension straps are used per container.

A disadvantage of both designs of the lid or the system of lid and container, as the case may be, is a time-consuming manual activity for opening and closing such a system. In particular with industrial applications of the container in series production with a tight time cycle, a reduction of the handling effort can be used to increase efficiency.

SUMMARY

As such, the object of the disclosure is to reduce the number of manual operations required to open or close, as the case may be, a system consisting of a lid and a container. In particular, the locking/unlocking of the lid should be made possible with one manual operation.

The object is achieved by a lid with the features as disclosed herein along with a system comprising a container and the lid as disclosed herein.

A lid for closing a container, in particular a container for an explosive hazardous material, has at least one connector on at least two opposite lateral edges. At least one connector arranged at a lateral edge is mounted so as to be movable largely perpendicularly in relation to the lateral edge and largely parallel to the lid plane.

The lid has a guide on its upper side and/or lower side for guiding the movable connector and for preventing the connector from moving largely perpendicularly to the lid plane. In accordance with the invention, a largely perpendicular or largely parallel, as the case may be, movement permits a deviation of ±20°, preferably ±15°, from the corresponding direction of movement. The connectors are dimensioned in such a manner that they can transmit acting loads from the lid to the container and/or from the container to the lid. The guide attached to the lid is also dimensioned accordingly. The perpendicular or parallel, as the case may be, movement of the connector in relation to the lid plane in accordance with the invention enables the faster and easier operation of the closing mechanism of the lid.

The movable connector is movable between a parked position within the lid plane and a closed position with which the movable connector protrudes from the lateral edge. In this manner, a lid in accordance with the invention, adapted in size, can be inserted into existing or known, as the case may be, containers and connected to the container by means of the connectors.

At least one connector located on the lateral edge opposite the movable connector is preferably rigidly connected to the lid in relation to the lateral edge. The positioning of the movable connectors on the lid on one lateral edge reduces handling effort, in particular for large containers, since a user does not have to walk around the container, for example.

At least one rigid connector is preferably formed as a hinge connector. This preferably allows the lid to be inserted into a receptacle of the container with a twisting movement with respect to the lateral wall of the container. The insertion of the lid with a twisting movement simplifies handling and facilitates the positioning of the lid in relation to the container.

Preferably, on the upper side and/or the lower side of the lid plane a structural element is arranged, preferably on the upper side, even more preferably a structural element is arranged on the upper side in the form of an actuating element, and at least two of the movable connectors are movable by means of a common structural element, preferably the actuating element. The use of at least two movable connectors increases the transmittable forces between the lid and the container. The fact that the movable connectors can be moved together by means of a common structural element, preferably an actuating element, reduces the effort required for handling the lid. The placement of the actuating element on the upper side enables a closed lid plane. This allows the lid to seal a container tightly.

The structural element preferably has at least one spring, preferably a spring formed by the structural element itself, for pretensioning the movable connectors to a position protruding beyond the lateral edge. Such a snap mechanism increases the safety of the closing process.

The spring connected to the structural element, preferably formed by the structural element, can preferably be reinforced by a further spring additionally attached between the structural element and the spring. This allows the spring force to be adapted to different requirements without changing the basic structure.

The structural element, the spring and/or the movable connector are preferably manufactured as one assembly. This reduces the unit costs of the lid compared with an assembly from individual parts. Manufacturing in an assembly is also understood to mean manufacturing the assembly using multi-component injection molding.

The structural element and/or assembly is preferably made of a plastic, preferably polypropylene, polyethylene and/or ESD-capable plastics. The use of plastic, in particular an injection-molded material, enables cost-effective, lightweight lids, structural elements, assemblies along with connections that can be produced from injection molding. Plastics within the meaning of the invention also include plastics produced by biological processes. In accordance with the invention, the lid, structural elements and/or assemblies can also be reinforced by the introduction of fibers. This also includes interwoven fibers, rods, bars or composite structures made from them.

The lid has ideally at least two structural elements, preferably two structural elements each having two connectors allocated to a common lateral edge. The use of two structural elements, each with two connectors, enables the secure closing of containers with a large footprint in relation to the height of the container and that is designed for appropriate forces.

At least one connector preferably has an at least partially circumferential groove, more preferably in the region of the connector that protrudes beyond the lateral edge in the closed position. In the event of a load, the circumferential groove can hook into the container or the receptacle of the container, as the case may be, and increase the forces that can be transmitted. For this purpose, a hook dips at least partially into the associated receptacle.

At least one lateral edge without a connector has at least one hook. On the one hand, the hook improves the positioning of the lid with respect to the container and, on the other hand, increases the transmissible loads acting on the lid from the outside.

It is preferred that at least one lateral edge without a connector has at least one hook. The hook can be used as a positioning aid or to transmit forces acting on the lid. The protruding lateral hooks or surfaces, as the case may be, preferably have a ribbed structure that dips into the receptacle. In the event of a load, this allows greater forces to be absorbed.

Preferably, the upper side of the lid has at least one reinforcing rib for preventing the lid from bending. This design increases the resistance of the lid with respect to forces acting on the lid plane. By analyzing the bending lines in the load case, taking into account the material properties of the lid material used, the reinforcing rib can be positioned on the lid plane. To reduce weight, it may be necessary to form a honeycomb-like structure by means of reinforcing ribs and, if necessary, to close this structure with an additional lid plane. Filling a cavity formed by the two lid planes and reinforcing ribs with foam can additionally further increase the flexural rigidity.

The guide of the connector is preferably formed by at least one reinforcing rib. Through these preferred designs, forces of the connector are diverted to specially designed parts of the lid.

The hook, the reinforcing rib and/or the lid plane ideally comprises one cohesive assembly. Such embodiment enables the simplified manufacturing of a lid while increasing the stability of the lid.

Furthermore, the object of the invention is achieved by a system comprising a container having a bottom and lateral walls, and the lid. For each connector of the lid, there is a complementary receptacle, preferably an aperture, in the lateral wall of the container for receiving the connector. The corresponding receptacles or apertures, as the case may be, allow the force application points to be specifically positioned on the lateral walls of the container. This can improve the resistance of the system of lid and container.

For positioning the lid and absorbing forces acting on the upper side of the lid a complementary bearing surface in the lateral wall of the container for each hook of the lid is preferably provided. The combination of the hooks with the bearing surface enables the precise positioning of the lid with respect to the container. This simplifies handling. Incorrect positioning of the lid is avoided if hooks and complementary bearing surfaces on the lateral walls of the container are positioned in such a manner that the lid can only be inserted into the container in one position. This can be achieved, for example, by means of an asymmetrical distribution of the bearing surfaces on the lateral wall.

The lid plane is ideally smaller than the area bounded by the lateral walls of the container. This allows the lid to be inserted into the container and not protrude beyond the lateral edges of the container. This results in stackability of the container without applying force to the lid.

It is preferred that at least the center of the complementary receptacles or apertures in the lateral wall has a distance a of ≥5%, preferably ≥10%, of the length of the lateral wall from the edge between two lateral walls of the container. Such distance divisions increase the resistance of the system. For containers conforming to the VDA 4500/VDA 4504 standard, the optimum force application points are at such distance.

The container closed with a lid ideally meets at least the requirements for a drop height and an internal pressure load standardized with UN hazardous materials approval. This meets in particular the requirement for the transport of dangerous goods, such as airbags or seatbelt tensioning systems, as the case may be. In particular, it is preferable to achieve approval class UN 4H2/X (X=packing groups 1 to 3) and/or UN 4H2/Y (Y=packing groups 2 to 3).

DETAILED DESCRIPTION

The invention is described in detail below with reference to the above figures in form and exemplary embodiments. In all figures, the same technical elements are marked with the same reference signs.

Figure 1:
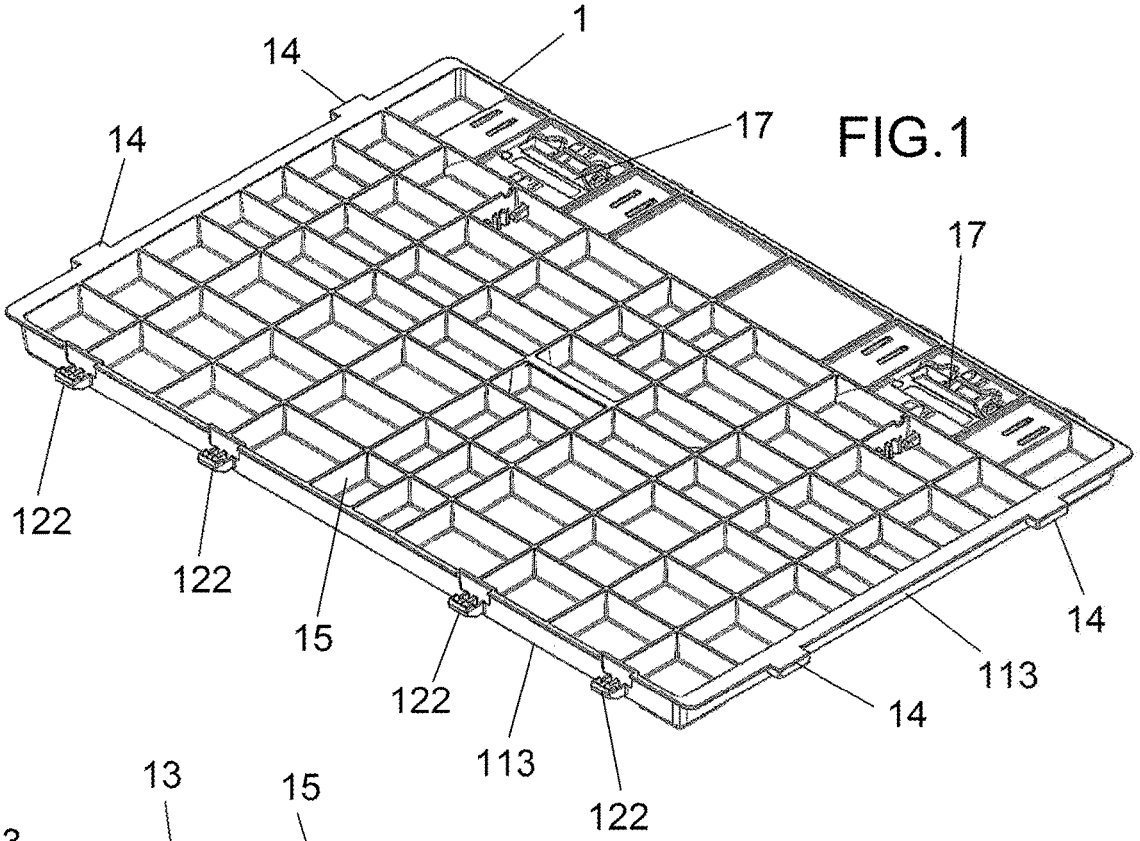
FIG. 1: View of lid.

FIG. 1 shows a lid 1 in accordance with the invention with four rigid connectors 122 allocated to one lateral edge 113 and four movable connectors 121 allocated to an opposite lateral edge 113. Furthermore, two hooks 14 are provided on each of two lateral edges 113. Two components 16 in the form of actuating elements 17 are attached to the upper side 111 of the lid plane 11. In each case, these act on two allocated movable connectors 121. The upper side 111 of the lid plane 11 is reinforced by a plurality of reinforcing ribs 15 parallel to the lateral edges 113 and forms a honeycomb-like, here rectangular, structure.

Figure 2A:
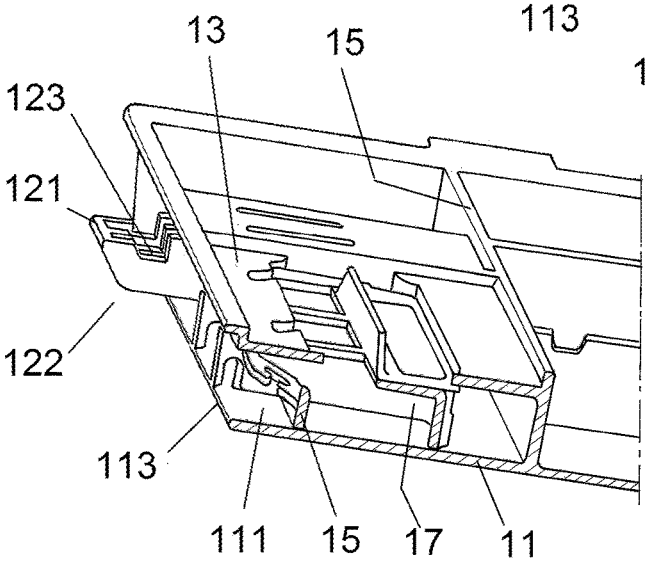
FIG. 2*a*: Section of the lid of FIG. 1.
Figure 2B:
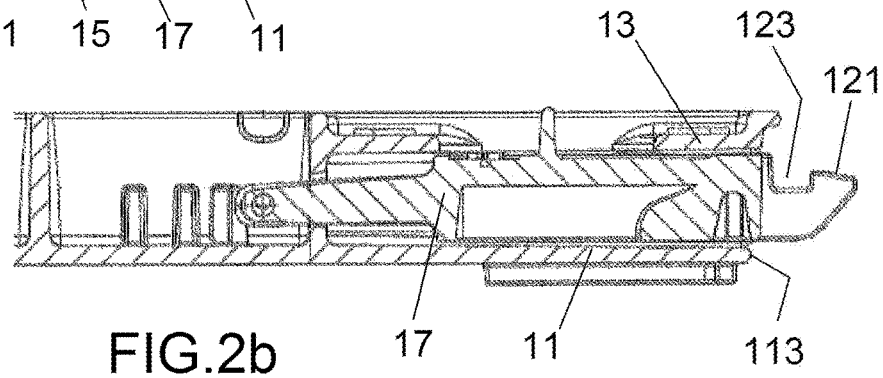
FIG. 2*b*: Cross section through subregion.

FIG. 2*a* shows a section of the lid 1 of FIG. 1 and FIG. 2*b* shows a cut through such subregion. An actuating element 17 with a connector 12 can be seen. The connector 12 has a partially circumferential groove 123. When the actuating element 17 is moved in the direction of the arrow, the connector 12 moves back and forth in a manner correspondingly perpendicular to the lateral edge 113 of the lid plane 11. A certain amount of play between the guide 13 of the connector 12 and the connector 12 itself can compensate for a positioning error of the lid 1 or the connector 12, as the case may be, with respect to a receptacle 21 or aperture 22 in a lateral wall 24 of a container 2.

Figure 3:
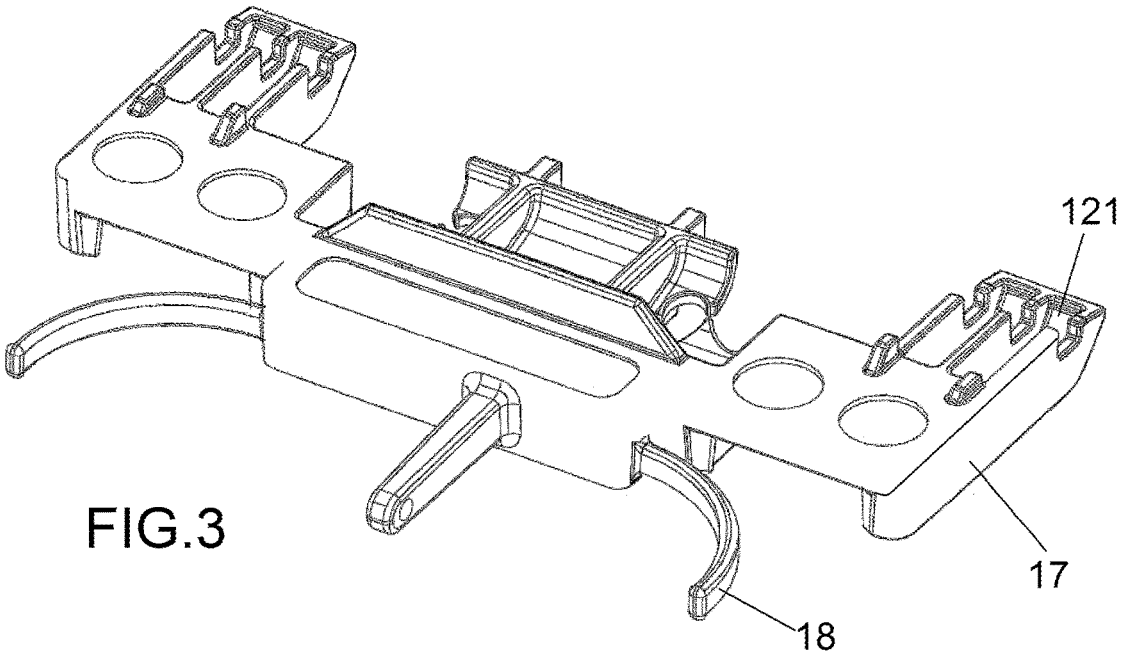
FIG. 3: Control element.

FIG. 3 shows an assembly 162 consisting of the connector 12, the actuating element 17 and two springs 18 formed by the assembly 162 or the component 16, as the case may be. Furthermore, two mounting points 161 for additional springs are attached to the actuating element 17. Thereby, the additional spring not shown here can be attached between the leaf spring formed by the actuating element and the mounting point 161. Furthermore, the actuating element 17 has an additional pin 163 on its side turned away from the connectors 12. Such pin 163 can be connected to the lid 1 by means of an aperture in a reinforcing rib 15 and an aperture in the pin 163 through a seal 19. When the actuating element 17 or the connector 12, as the case may be, is moved with respect to the reinforcing rib 15, the seal 19 is broken.

Figure 4:
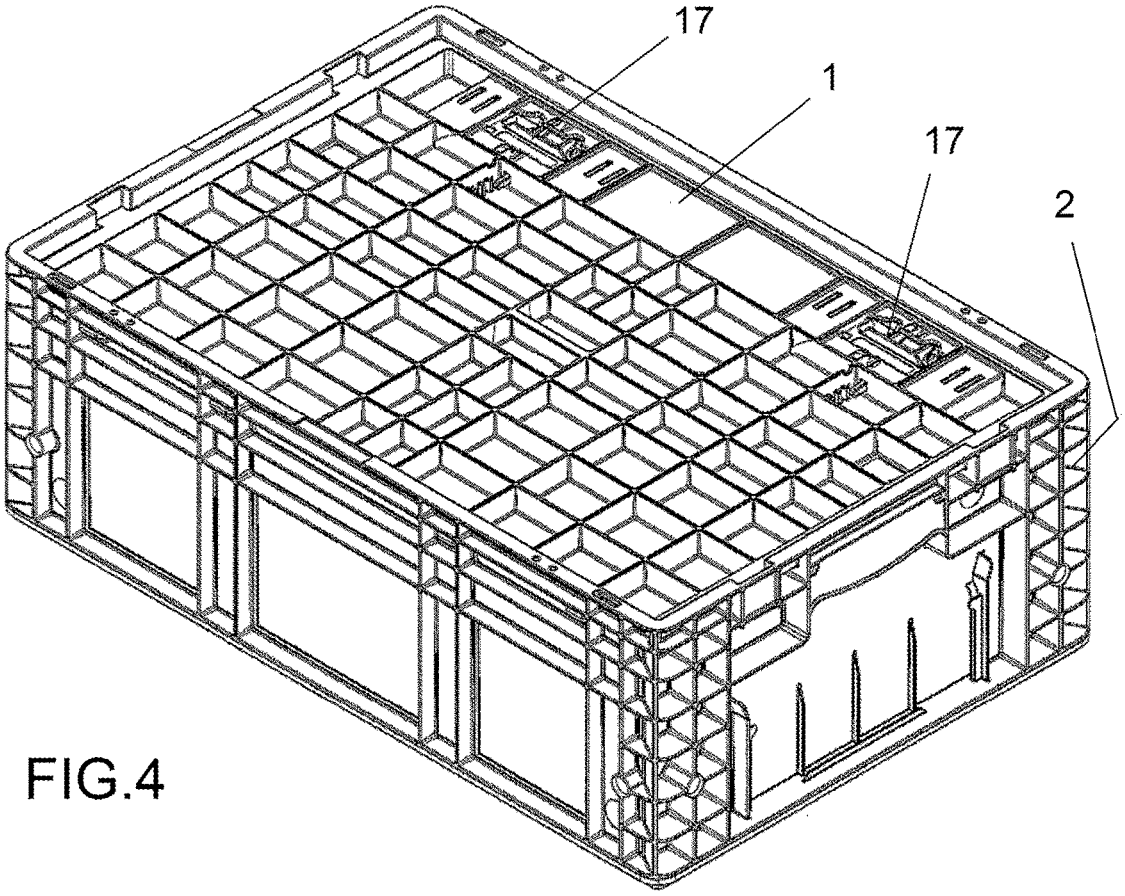
FIG. 4: View of container with lid.

FIG. 4 shows a system consisting of a container 2 and a lid 1 in accordance with the invention. The lid 1 is hooked into the complementary receptacles by means of the rigid connectors 122 on a lateral wall 24 of the container 2, and can be inserted into the container 2 by means of a pivoting movement (arrow). After the lid 1 has been inserted, the movable connectors 121 are returned to the closed position 124 and the container 2 is thereby closed with the lid 1.

Figure 5:
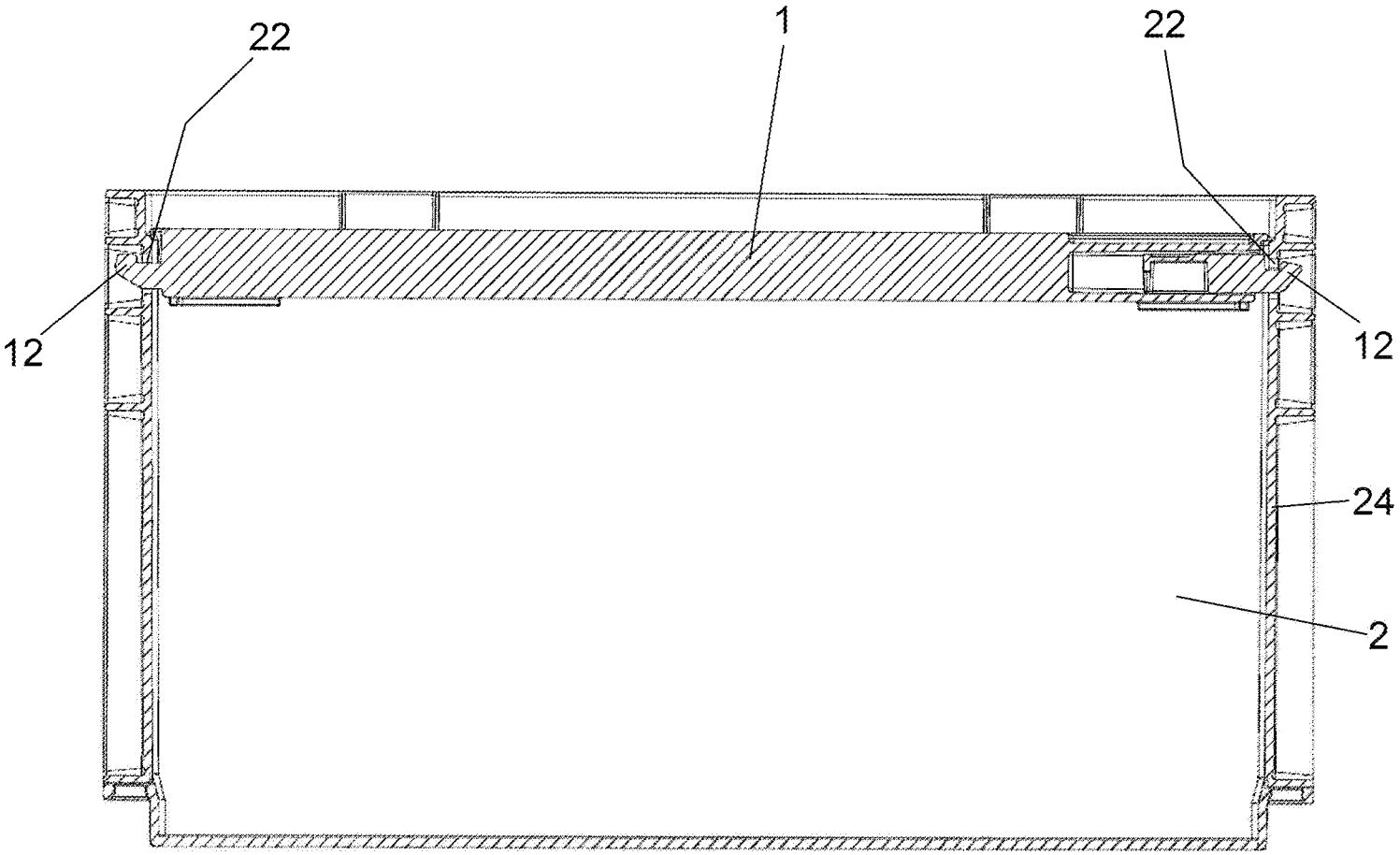
FIG. 5: Cross section through container with a closed lid.

FIG. 5 shows a cut through a container 2 shown in FIG. 4 with the lid 1 closed. Both the rigid connectors 122 and the movable connectors 121 prevent the lid 1 from moving perpendicular to the lid plane 11 with respect to the container 2. When the lid 1 or the lid plane 11, as the case may be, is loaded from its lower side 112, the grooves 123 in the connectors 12 interlock with the lateral walls 24 of the container 2.

REFERENCE CHARACTERS

| Number | Description |
|---|---|
| 1 | Lid |
| 11 | Lid plane |
| 111 | Upper side |
| 112 | Lower side |
| 113 | Lateral edge |
| 12 | Connector |
| 121 | Movable connector |
| 122 | Rigid connector |
| 123 | Groove |
| 124 | Closed position |
| 125 | Parked position |
| 13 | Guide |
| 14 | Hook |
| 15 | Reinforcing rib |
| 16 | Component |
| 161 | Mounting point |

-continued

REFERENCE CHARACTERS

| Number | Description |
|---|---|
| 162 | Assembly |
| 163 | Pin |
| 17 | Actuating element |
| 18 | Spring |
| 19 | Seal |
| 2 | Container |
| 21 | Receptacle |
| 22 | Aperture |
| 23 | Bearing surface |
| 24 | Lateral wall |
| 25 | Bottom |
| a | Spacing |

The invention claimed is:

1. A lid (1) for closing a container (2), in particular a container (2) for a hazardous material, comprising:

a lid plane (11) with an upper side (111), a lower side (112), and at least four lateral edges (113); and connectors (12), including a movable connector (121) arranged at a lateral edge (113) of the at least four lateral edges (113), and a further connector (12) arranged at an opposite lateral edge (113) of the at least four lateral edges (113), wherein the movable connector (121) is mounted so as to be movable largely perpendicularly in relation to the lateral edge (113) and largely parallel to the lid plane (11), and wherein the lid (1) includes a guide (13) for guiding the movable connector (121) and preventing a largely perpendicular movement of the movable connector (121) to the lid plane (11), and wherein at least one lateral edge (113) without connector (12) has at least one lateral hook (14).

2. The lid according to claim 1, wherein the movable connector (121) is movable between a parked position (125) within the lid (1) and a closed position (124) in which the movable connector (121) protrudes from the lateral edge (113).

3. The lid according to claim 2, wherein the movable connector (121) has an at least partially circumferential groove (123) in a region of the movable connector (121) that protrudes beyond the lateral edge (113) in the closed position (124).

4. The lid according to claim 1, wherein the further connector (12) located on the lateral edge (113) opposite the movable connector (121) is rigidly connected to the lid (1).

5. The lid according to claim 1, wherein the movable connector (121) comprises at least two movable connectors (121), wherein an actuating element (17) is arranged on the upper side of the lid plane; and wherein the at least two movable connectors (121) are movable by the actuating element (17).

6. The lid according to claim 5, wherein the lid (1) has at least two actuating elements (17) allocated to a common lateral edge (113), each having two movable connectors (121).

7. The lid according to claim 1, wherein the upper side (111) and/or lower side of the lid (1) has at least one reinforcing rib (15) for preventing or making it more difficult for the lid to bend.

8. The lid according to claim 7, wherein the guide (13) of the movable connector (121) is formed by a reinforcing rib (15).

9. The lid according to claim 7, wherein the hook (14), the reinforcing rib (15) and/or the lid plane (11) comprises one cohesive assembly.

10. A system comprising a container (2) having a bottom (25) and lateral walls (24); and the lid (1) according to claim 1, wherein for each connector (12) of the lid (1) there is a complementary receptacle (21) in form of an aperture (22) in one of the lateral walls (24) of the container (2) for receiving the respective connector (12).

11. The system according to claim 10, wherein for positioning the lid (1) and absorbing forces acting on the upper side (111) of the lid (1), there is a complementary bearing surface (23) in the lateral walls (24) of the container (2) for each lateral hook (14) of the lid (1).

12. The system according to claim 10, wherein the lid plane (11) is smaller than an area bounded by the lateral walls (24) of the container (2).

13. The system according to claim 10, wherein at least a center of the complementary receptacle (21) or aperture (22) in the lateral walls (24) has a distance (a) of ≥10% of a length of the lateral wall (24) from the edge between two lateral walls (24) of the container.

14. The system according to claim 10, wherein the container is a dangerous goods packaging in compliance with approval classes UN 4H2/X and/or UN 4H2/Y of the UN standard for dangerous goods packaging GGVS-ADR-RiD.

15. A lid (1) for closing a container (2), in particular a container (2) for a hazardous material, comprising:

a lid plane (11) with an upper side (111), a lower side (112), and at least four lateral edges (113); and connectors (12), including a movable connector (121) arranged at a lateral edge (113) of the at least four lateral edges (113), and a further connector (12) arranged at an opposite lateral edge (113) of the at least four lateral edges (113), wherein the movable connector (121) is mounted so as to be movable largely perpendicularly in relation to the lateral edge (113) and largely parallel to the lid plane (11), wherein the lid (1) includes a guide (13) for guiding the movable connector (121) and preventing a largely perpendicular movement of the movable connector (121) to the lid plane (11), wherein the further connector (12) located on the lateral edge (113) opposite the movable connector (121) is rigidly connected to the lid (1), and wherein the rigidly connected further connector (122) is formed as a hinge connector.

16. A lid (1) for closing a container (2), in particular a container (2) for a hazardous material, comprising:

a lid plane (11) with an upper side (111), a lower side (112), and at least four lateral edges (113); and connectors (12), including a movable connector (121) arranged at a lateral edge (113) of the at least four lateral edges (113), and a further connector (12) arranged at an opposite lateral edge (113) of the at least four lateral edges (113), wherein the movable connector (121) is mounted so as to be movable largely perpendicularly in relation to the lateral edge (113) and largely parallel to the lid plane (11), wherein the lid (1) includes a guide (13) for guiding the movable connector (121) and preventing a largely perpendicular movement of the movable connector (121) to the lid plane (11), wherein the further connector (12) located on the lateral edge (113) opposite the movable connector (121) is rigidly connected to the lid (1), wherein the movable connector (121) comprises at least two movable connectors (121), wherein an actuating element (17) is arranged on the upper side of the lid plane; and wherein the at least two movable connectors (121) are movable by the actuating element (17), and wherein the actuating element (17) has at least one spring (18) formed by the actuating element (17) for pretensioning the movable connector (121) into a position protruding beyond the lateral edge (113) of the lid (1).

17. The lid according to claim 16, wherein the spring (18) formed by the actuating element (17) can be reinforced by an additional spring (181) attached between the actuating element (17) and the spring (18).

18. The lid according to claim 16, wherein the actuating element (17), the spring (18), and/or the movable connector (121) are manufactured as one assembly.

19. The lid according to claim 18, wherein the actuating element (17) and/or the assembly is made of polypropylene, polyethylene and/or ESD-capable plastic.

* * * * *